US005685814A

United States Patent [19]

Le

[11] Patent Number: 5,685,814

[45] Date of Patent: Nov. 11, 1997

[54] BOX SEALER

[76] Inventor: Tuan Vinh Le, 502 Malaga Road, Mississauga, Ontario, Canada, L5B 3W2

[21] Appl. No.: 589,675

[22] Filed: Jan. 22, 1996

[51] Int. Cl.[6] ..... B31B 1/72

[52] U.S. Cl. ..... 493/117; 493/147; 53/377.2; 53/378.3

[58] Field of Search ..... 493/116, 117, 493/147, 183, 156, 157; 53/491, 377.2, 378.3

[56] References Cited

U.S. PATENT DOCUMENTS

| | | | |
|---|---|---|---|
| 3,199,262 | 8/1965 | Miller | 493/117 |
| 3,505,774 | 4/1970 | Gidge | 493/117 |
| 3,800,679 | 4/1974 | Bartelheimer | 493/117 |
| 4,572,760 | 2/1986 | Marchetti | 156/468 |
| 4,658,563 | 4/1987 | Lissoni | 493/117 |
| 4,748,794 | 6/1988 | Marchetti | 53/137 |

*Primary Examiner*—Jack W. Lavinder
*Attorney, Agent, or Firm*—Barrigar & Moss

[57] ABSTRACT

A box or carton sealer is disclosed having a frame with a conveyor for moving boxes therethrough. A pair of longitudinal, laterally spaced-apart gravity operated centering bars are linked together and move inwardly and outwardly in unison to centre the boxes in the sealer. A first floating head has an inclined entry ramp for riding up over the box folding the box forward end flap inwardly. This floating head also has a pivoting arm for folding inwardly the rear end flap of the box, and diverging side bars for folding inwardly the side flaps of the box. A second floating head has an entry ramp for riding up on top of the inwardly folded flaps of the box. The second head has a tape dispenser for applying tape to the flaps at whatever height they happen to be at to tape the box shut.

18 Claims, 6 Drawing Sheets

BOX SEALER

FIELD OF THE INVENTION

This invention relates to box or case sealers, being apparatus to tape shut open ends of cardboard boxes or cartons and the like.

BACKGROUND OF THE INVENTION

In the packaging industry, many products are packed in cardboard boxes or cartons for shipping. Often, one end of the box, namely the bottom, is sealed shut before the box is filled, and after the box is filled, the open top end of the box has to be sealed shut. The open top end of the box is usually comprised of end and side flaps that are folded inwardly and downwardly. The box can be sealed by applying glue to the inside or mating surfaces of the folded flaps prior to them being folded, or by applying tape to the outside of the flaps after they have been folded shut.

In most cases, the boxes are uniform in size, so providing apparatus that will fold the flaps and apply adhesive or tape thereto is not particularly difficult to do. The apparatus can be adjusted to suit the known width and height of the boxes and there is no problem running the boxes through the case sealer once it is adjusted properly.

However, sometimes the boxes are used to pack articles that are not uniform in size, with the result that the boxes are overfilled or underfilled. In some instances, it is also desirable to be able to handle boxes of different sizes coming down the same conveyor line. In these instances, a random case sealer is required, wherein the apparatus for folding the box flaps and applying adhesive or tape thereto adjusts automatically to suit the size of the box.

In prior art random case sealers, various sensors have been used to determine the exact size and position of the boxes in the case sealer, and numerous actuators or other adjusting mechanisms together with programmable logic controls have been used to adjust the position of the various folding and sealing components in response to what is sensed by the sensors. A difficulty with this type of apparatus is that the numerous sensors and actuators are prone to mechanical breakdown and expensive maintenance problems. Further, an overfilled box is not uniform in shape, so the sensors often cannot determine the optimum position adjustments, with the result that the boxes get jammed in the apparatus shutting down the packaging line.

SUMMARY OF THE INVENTION

The present invention is a very simple apparatus wherein the folding and sealing components are moved mechanically in response to the exact shape of the box, so the maintenance and jamming problems of the prior art are largely eliminated.

According to the invention, there is provided a box or carton sealer comprising a frame having a longitudinal axis and including a conveyor for moving boxes along the axis through the sealer. A pair of longitudinal, laterally spaced-apart centering bars are linked together to move inwardly and outwardly to match the width of a box passing therethrough. The bars include diverging entry portions forming a throat to center the box therebetween. Means urge the bars inwardly into engagement with the box. A first floating head is spaced above the centering bars. This first head includes an upwardly inclined entry ramp adapted to engage and fold inwardly a forward end flap on the box. The first head lifts upwardly by the box engaging the inclined entry ramp. The first head includes a pivoting arm assembly pivotable downwardly after the box passes thereunder to fold inwardly a rearward end flap on the box. The first head further includes diverging side bars for engaging and folding inwardly side flaps on the box after the rearward end flap has been folded inwardly. Also, a second floating head is located downstream of the first floating head. The second floating head is adapted to mount a tape dispenser centrally thereon. The second floating head includes means to hold the box side flaps down on top of the box end flaps. An upwardly inclined entry ramp is adapted to be engaged by the box on the conveyor to lift the second floating head to a predetermined desired height for engagement of the tape dispenser against the box flaps to tape the box shut.

BRIEF DESCRIPTION OF THE DRAWINGS

Preferred embodiments of the invention will now be described, by way of example, with reference to the accompanying drawings, in which.

DETAILED DESCRIPTION OF THE PREFERRED EMBODIMENT

Figure 1:
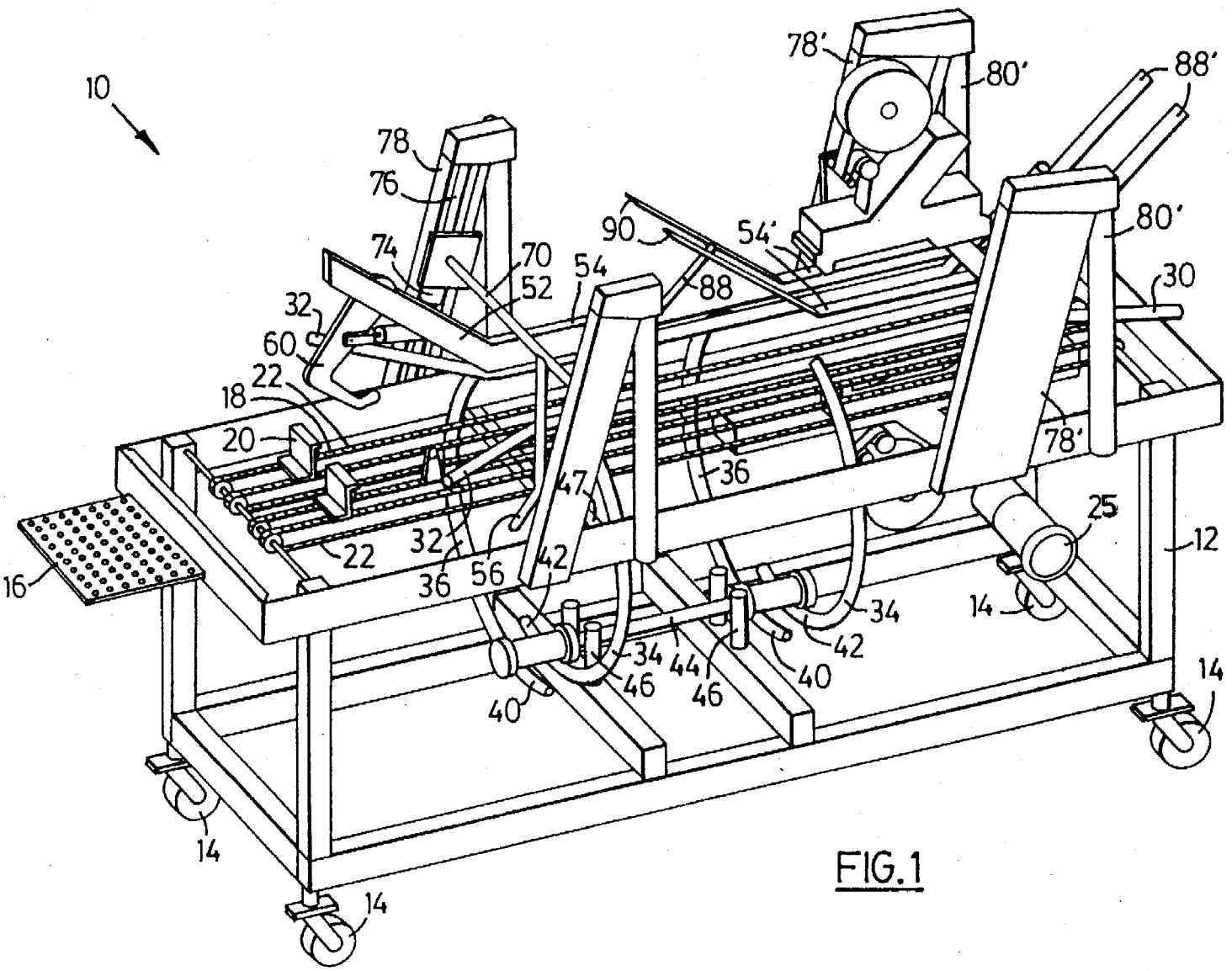
FIG. 1 is a perspective view of a preferred embodiment of a box sealer according to the present invention.

Referring to the drawings, a preferred embodiment of a box sealer according to the present invention is generally indicated in the drawings by reference numeral 10. Box sealer 10 includes a frame 12 mounted on casters 14, so that box sealer 10 is easily transportable or moveable from one packaging line to another. A portion of a conveyor packaging line is represented in the drawings by reference numeral 16. Box sealer 10 is located to close and seal, one at a time, filled boxes received from packaging line 16. For this purpose, a suitable cam operated gating mechanism 17 (see FIG. 2) is employed, as will be familiar to those skilled in the art. Alternatively, the gating mechanism could be incorporated in packaging line 16. Either way, the boxes are spaced apart as they are fed through box sealer 10. Packaging line 16 is not considered to be part of the present invention, so it will not be described in further detail herein.

Frame 12 has a longitudinal axis along which is centrally mounted a conveyor 18 for receiving boxes from packaging line 16. Conveyor 18 includes pushers 20 for pushing the boxes through box sealer 10. Pushers 20 are mounted on continuous conveyor chains or belts 22 and have live rollers 24 to facilitate the boxes sliding in a transverse direction to be centered in box sealer 10, as will be described further below. Rollers 24 are disposed at a slight downward angle to avoid a tendency for pushers 20 to lift the boxes off conveyor 18.

Pushers 20 move the boxes longitudinally through box sealer 10 in the direction of the longitudinal axis (not shown) through box sealer 10. Although only one set of pushers 20 is shown in the drawings, multiple sets of these pushers are provided on belts 22 at spaced-apart locations to move the boxes through the box sealer at the desired spacing therebetween. Belts 22 are driven by a suitable motor 24 and connecting chain or belt 26 (see FIG. 2).

A pair of longitudinal, laterally spaced-apart centering bars 28, 30 is used to center the boxes in box sealer 10. Centering bars 28, 30 are linked together to move inwardly and outwardly in unison to match the width of a box passing therethrough. These centering bars include diverging entry portions or bars 32 that are disposed at an angle from the longitudinal axis of box sealer 10 of about 30 to 35 degrees and are slightly upwardly inclined to urge the boxes downwardly into contact with conveyor belts 22. Diverging bars 32 form a throat to center the box therebetween. If the box is laterally offset, or not centered, it will hit one of the diverging bars 32 and not the other, and the diverging bar that it hits moves it over onto the centerline or longitudinal axis of box sealer 10 where it engages both diverging bars 32 and forces centering bars 28, 30 to move outwardly to accommodate the exact width of the box.

Centering bars 28, 30 are urged inwardly to engage the boxes passing therethrough by means of transverse pivot members 34, 36 attached thereto. Pivot members 34, 36 are pivotally mounted in the frame by hinge members 38 (see FIG. 4). The pivot points 39 of the hinge members 38 are located at points vertically spaced from centering bars 28, 30, so that as the pivot members 34, 36 pivot, centering bars 28, 30 move in and out towards and away from the centerline of box sealer 10. The lower portions of pivot members 34, 36 are cantilevered weighted portions and as such, urge by gravity the centering bars 28, 30 into engagement with a box located between the bars.

Figure 4:
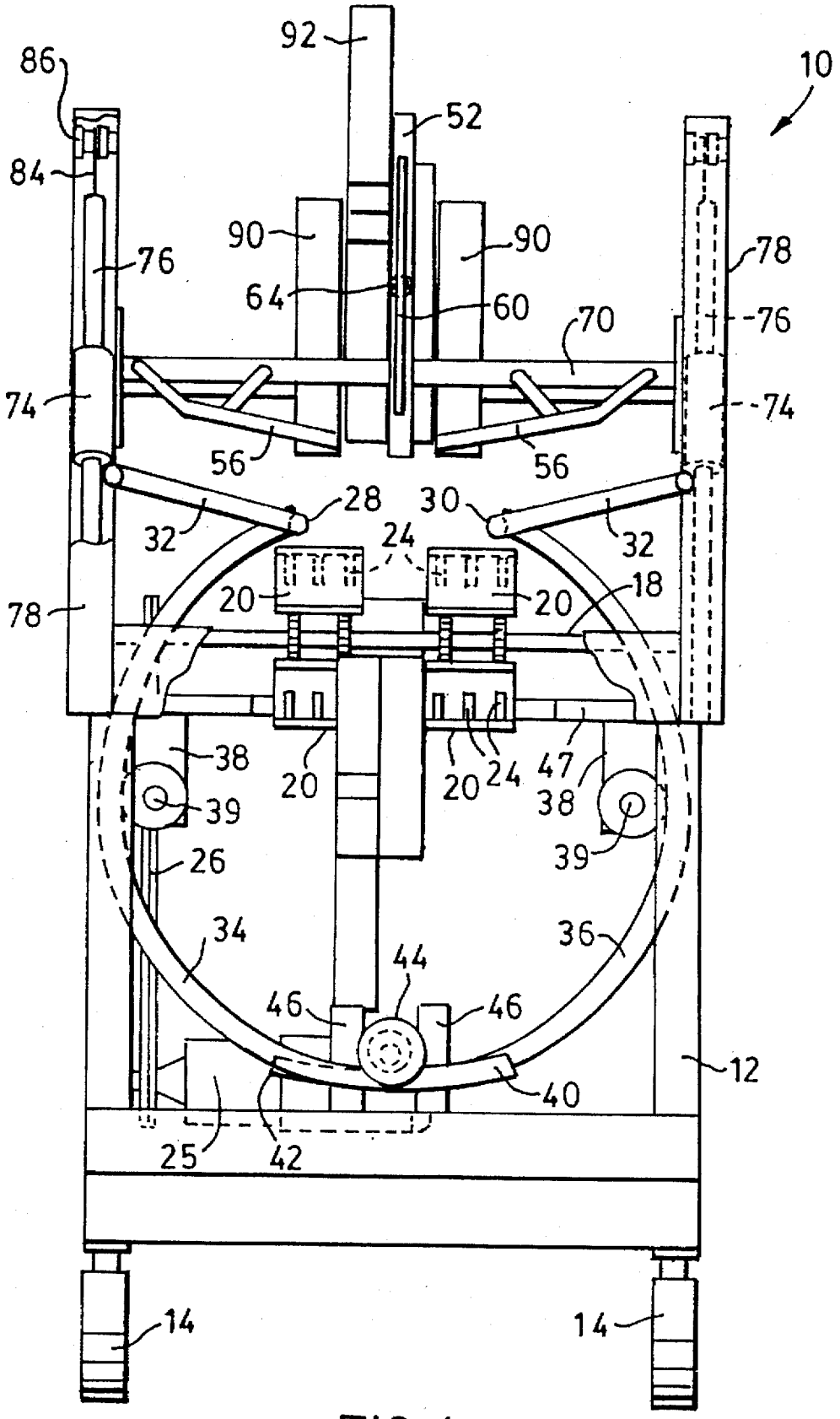
FIG. 4 is an end view of the box sealer taken along lines 4—4 of FIG. 3.

As seen best in FIGS. 1 and 4, pivot members 34, 36 are crescent shaped and extend downwardly and inwardly under centering bars 28, 30 to distal end portions 40, 42 which cross or overlap in the respective pairs of laterally adjacent pivot members. A longitudinal weight 44 is cradled or supported on these overlapping distal end portions 40, 42. Upright posts 46 restrict weight 44 to vertical movement, so that the same cantilevered weight is applied to each centering bar 28, 30. As seen best in FIG. 4, when one of the centering bars 30 is urged outwardly, such as by a box being off-centered, weight 44 is lifted by the respective pivot member attached to this bar. This frees the other centering bar and pivot member to move as the box moves over. When the box is centered, both distal end portions 40, 42 again engage weight 44, so that the same forces apply to the box by each centering bar 28, 30. The bars are thus moved in unison. Weight 44 is sufficiently heavy such that normally, when an off-center box engages one of the centering bars or diverging bars 32, it will not move these bars outwardly. Rather, the box will be moved inwardly by these bars until both diverging bars 32 are engaged, in which case centering bars 28, 30, then move outwardly in unison by the same amount to accommodate the box passing therethrough.

In the event that very heavy boxes are desired to be sealed in box sealer 10, such that cantilevered weight 44 is not sufficient to ensure that centering bars 28, 30 do cause these boxes to move over to the centerline of box sealer 10, a positive linking mechanism 47 (see in particular FIGS. 3 and 6 to 8) is used to limit the outward movement of centering bars 28, 30. Linking mechanism 47 includes a center housing 49 fixed in position in box sealer 10 and having a pair of sliding arms 51, 53 telescopically located therein. One of the sliding arms 51, 53 is connected to each of the pivot members 34, 36. Each sliding arm 51, 53 has a respective transversely moveable pin 55, 57 located therein that engages a respective cam 59, 61 on the adjacent sliding member. Pins 55, 57 in turn engage respective housing cam portions 63, 65, the latter having respective stops 67, 69 to limit the outward movement of the adjacent arms 51, 53.

Figure 6:
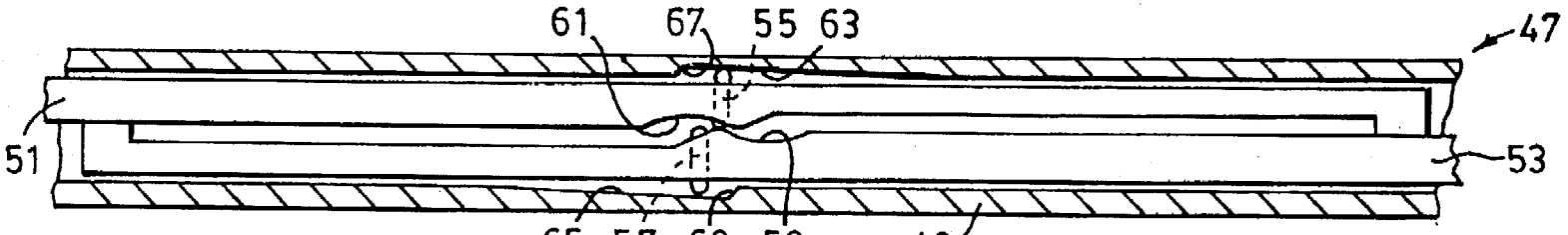
FIGS. 6 to 8 are partial sectional views of a linking mechanism used to help center boxes in the box sealer.
Figure 7:
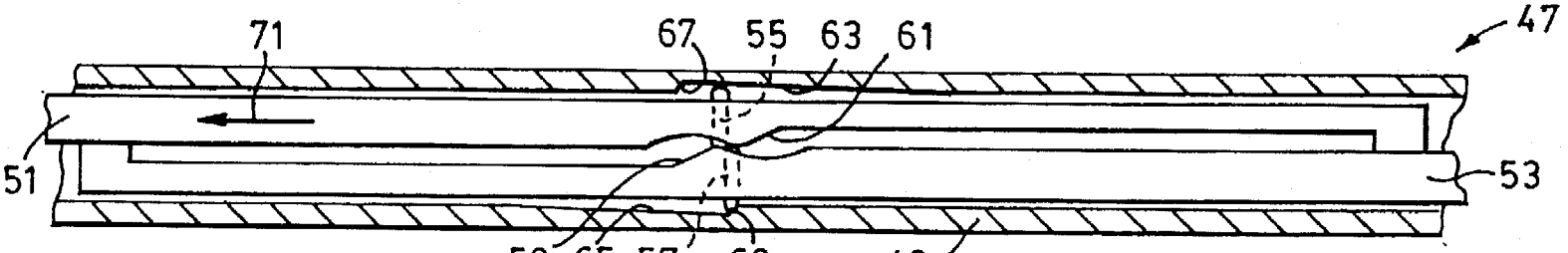
Figure 8:
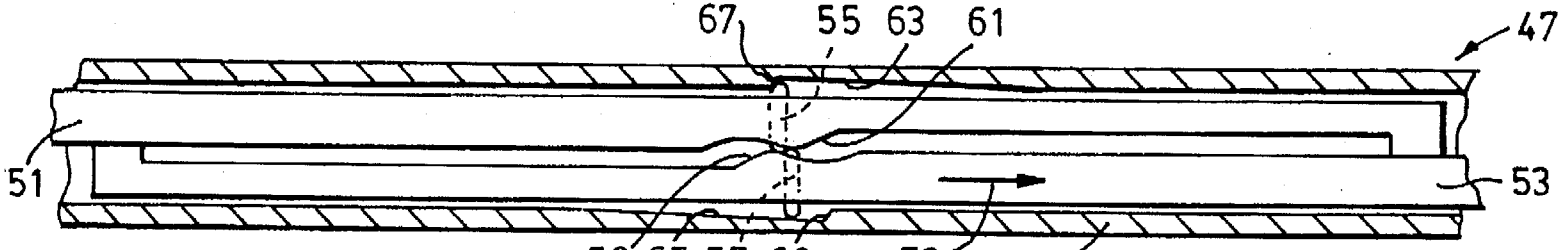

In the operation of linking mechanism 47, FIG. 6 shows the two sliding arms 51, 53 in a position to slide in either direction. In FIG. 7, sliding arm 53 has been pushed to the right (for example, by a heavy, off-centered box hitting centering bar 30). Pin 57 hits stop 69 preventing arm 53 from moving outwardly further, but arm 51 is free to move to the left as indicated by arrow 71. A box hitting centering bar 30 is thus forced to move over toward the center of box sealer 10, and when it hits centering bar 28, arm 51 moves to the left. When the box is centered, cam 61 allows pin 57 to retract allowing both centering bars 28, 30 to move further outwardly in unison to accommodate the actual width of the box. When the box passes through centering bars 28, 30, arms 51, 53 move inwardly again to reset themselves as indicated in FIG. 6. Similarly, in FIG. 8 sliding arm 51 has been pushed to the left (for example, by a heavy, off-centered box hitting centering bar 28). Pin 55 hits stop 67 preventing arm 51 from moving outwardly further, but arm 53 is free to move to the right as indicted by arrow 73. When the box is centered, pin 55 is allowed to retract by cam 59, allowing centering bars 28, 30 to open further as necessary (the box remaining centered). After the box passes through the centering bars 28, 30, the cantilevered pivot members 34, 36 cause arms 51, 53 to reset as in FIG. 6. Of course, if the box is centered properly as it enters centering bars 28, 30, both arms 51, 53 can move outwardly in unison to accommodate the actual width of the box.

Figure 2:
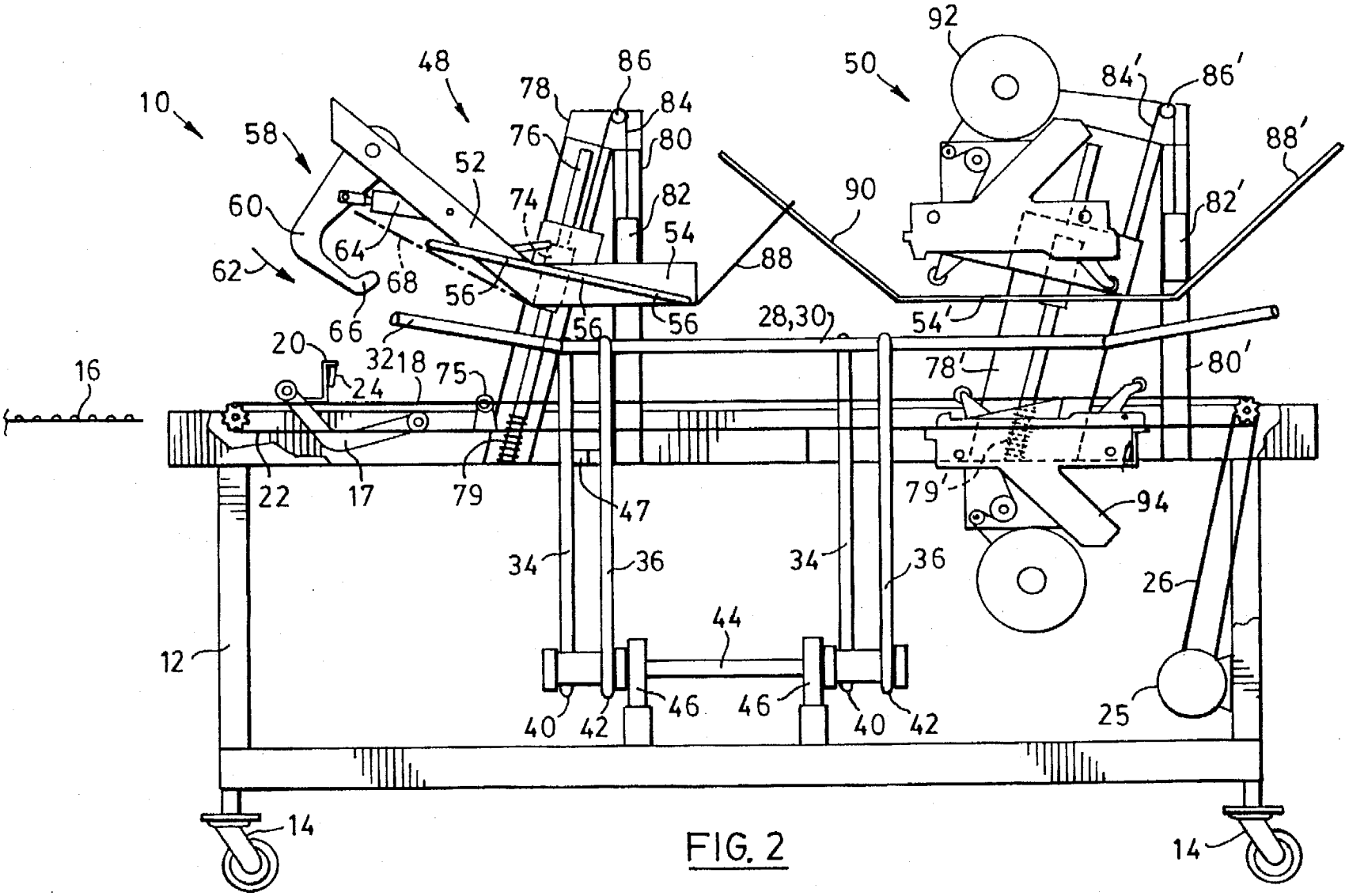
FIG. 2 is a side view of the box sealer of FIG. 1.
Figure 5:
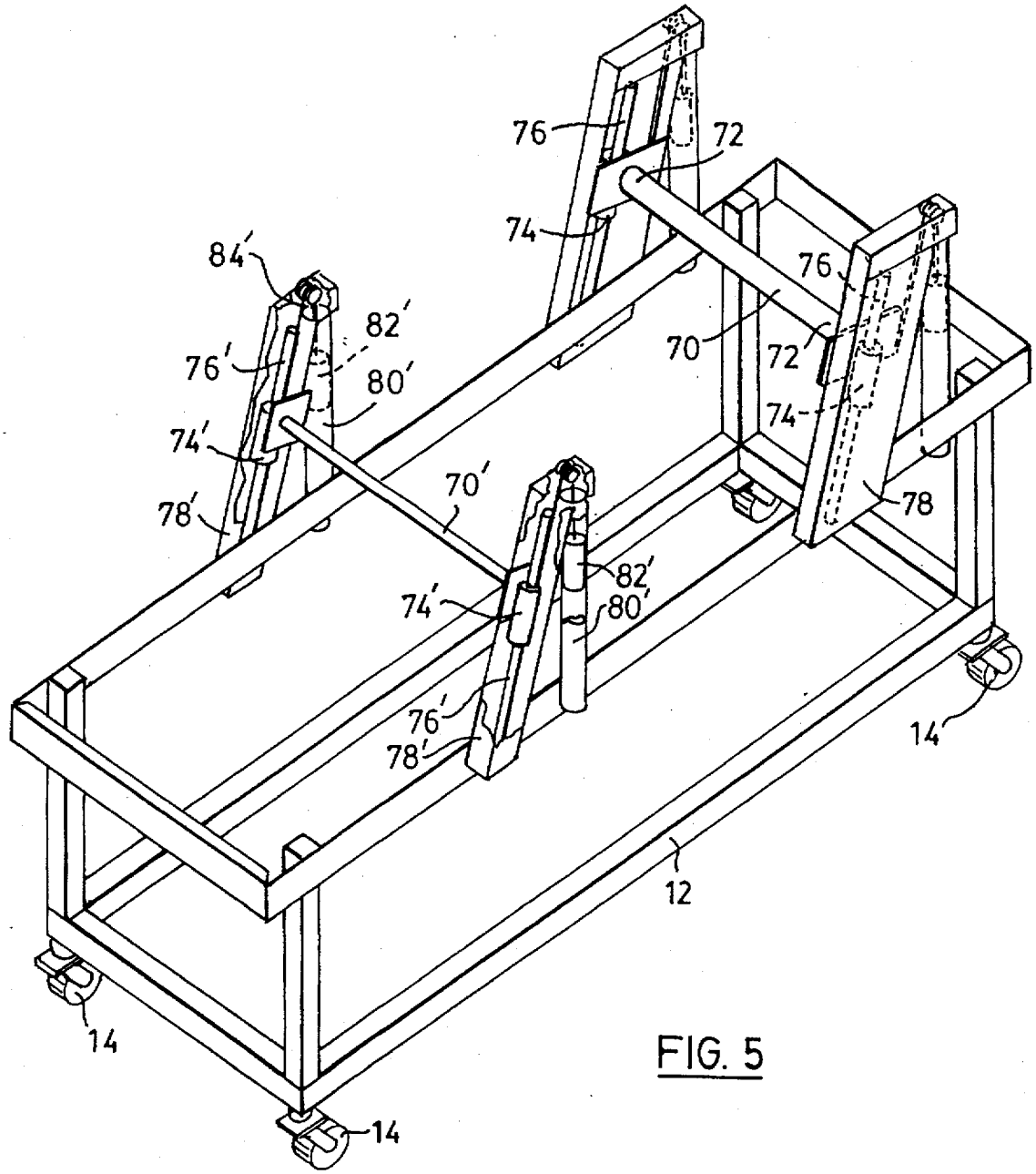
FIG. 5 is a perspective view of a portion of the frame of the box sealer shown in FIG. 1 illustrating the towers to mount the floating heads in the box sealer.

Referring next in particular to FIGS. 2 and 5, box sealer 10 includes first and second floating heads 48, 50 spaced above centering bars 28, 30. First floating head 48 includes an upwardly inclined bar forming an entry ramp 52 inclined at an angle from the horizontal of about 25 to 40 degrees. This entry ramp 52 engages and folds inwardly an upstanding, forward end flap of a box passing through box sealer 10. When the front face or forward side of the box per se hits entry ramp 52, it causes floating head 48 to lift or float upwardly until the floating head sits on top of the fully folded-down forward flap. The box then passes under a main horizontal portion 54 of floating head 48.

As the side flaps of the top of the box to be sealed in box sealer 10 enter the region of main portion 54, they are engaged by inclined or downwardly and inwardly sloping or diverging side bars 56, which engage the side flaps and fold them inwardly on top of the end flaps of the box. Before this happens, however, a pivoting arm assembly 58 including a pivoting arm 60 pivots downwardly in the direction of arrow 62 to engage the rear flap of the box passing thereunder and fold this rear flap inwardly and downwardly. Pivoting arm 60 is pivoted by an actuator 64 which is activated by a limit switch 75 (see FIG. 2), which senses when the box rear flap passes beneath and beyond pivoting arm 60. When the rear flap is folded inwardly and downwardly by pivoting arm 60, the box side flaps are then folded inwardly and downwardly by sloping bars 56. The side flaps hold the forward and rear flaps down.

Pivoting arm 60 includes an off-set distal end portion 66 to reduce the amount of travel required to make pivoting arm 60 close the rear box flap.

Figure 3:
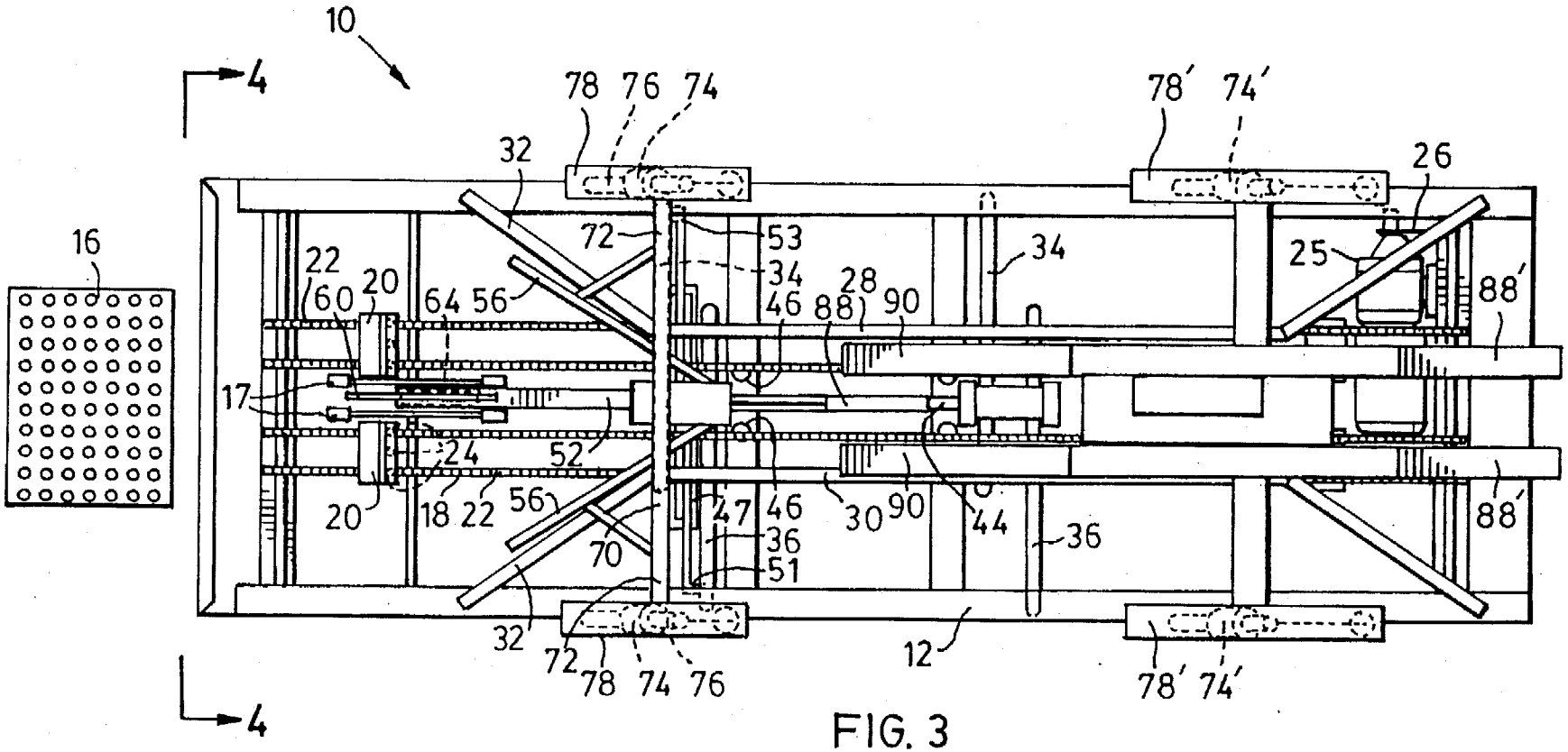
FIG. 3 is a top view of the box sealer of the present invention.

In place of the bar 52 as shown in FIGS. 1 to 3, a pair of spaced-apart plates located on either side of bar 52 could be used as the entry ramp, these plates being indicated in FIG. 2 by chain dotted lines 68.

Floating head 48 includes a transverse member 70 (see FIG. 1) having distal ends 72 attached to slides 74 mounted for vertical sliding movement on shafts 76 in inclined towers 78. Slides 74 are preferably in the form of linear bearings mounted on cylindrical shafts 76. Towers 78 are inclined from the vertical in a direction away from the travel of conveyor 18 at an angle between approximately 10 to 20 degrees from the vertical. Towers 78 further include counterweight portions 80 in which are located counterweights 82, the latter being attached by a chain or cable 84 passing over a pulley or sprocket 86 to the slides 74 to offset the weight of the portion of floating head 48 that slides along the main part of tower 78. This reduces the amount of force required to be exerted by the box on floating head 48 to cause it to ride up over the top of the box as the latter is being closed. Towers 78 also include shock absorbers 79 to cushion the downward sliding movement of slides 74. Shock absorbers 79 are in the form of springs, and since they are partially compressed when the floating head slides 74 are resting on them, this helps lift the floating head when a box initially contacts entry ramp 52.

First floating head 48 also includes a rear or downstream exit ramp 88 which engage the box as it passes thereunder to lower gently the floating head 48 as the box passes thereby.

As the box passes under exit ramp 88, the box flaps are still held down by exit ramp 88, and before the box clears exit ramp 88, the box engages an upwardly inclined entry ramp 90 of second floating head 50. Entry ramp 90 then takes over to hold the box flaps down and the force of the box against entry ramp 90 causes second floating head 50 to move upwardly in a manner similar to that of first floating head 48. The general construction of second floating head 50 is similar to that of first floating head 48 and primed reference numerals have been used in the drawings to indicate the parts of second floating head 50 that correspond to those of first floating head 48. It will be noted that the main portion 54' and the exit ramp 88' of second floating head 50 are in the form of two parallel parts, like entry ramp 90. As mentioned above, the same construction can be used for first floating head 48. The main difference between second floating head 50 and first floating head 48 is that second floating head 50 has a tape dispenser 92 centrally mounted thereon. Any conventional type of tape dispenser can be employed in box sealer 10 and the tape dispenser is not considered to be part of the present invention per se, so will not be described in further detail. Box sealer 10 also has a second optional tape dispenser 94 mounted in frame 12 to tape or seal the bottom flaps of the box passing thereover, if these flaps have not already been sealed by the time the box enters box sealer 10. It will be appreciated that main portions 54' hold the box side flaps down on top of the box end flaps while the box is passing under second floating head 50, so there is no need for means to fold the side flaps inwardly as in the case of sloping bars 56 of first floating head 48. The angle of inclination of ramps 90 and 88' are similar to the corresponding ramps in first floating head 48.

In operation, when a box enters box sealer 10, it is picked up by pushers 20 of conveyor 18 and pushed into engagement with diverging bars 32 to center the box in box sealer 10. The forward or leading box end flap is then folded down by engagement with entry ramp 52. The box itself then engages ramp 52 causing first floating head 48 to float or rise up. The rear or trailing end flap is then folded inwardly and down by pivoting arm 60. As the box progresses, sloping bars 56 fold the side flaps inwardly and downwardly. The box then passes into engagement with second floating head 50 which rises to the height of the box. It will be appreciated that if the box is overfilled, so that the flaps do not fold all the way down, floating head 50 will still float or rise upwardly to the exact height of the box, allowing tape dispenser 90 to tape the flaps shut without jamming.

Having described preferred embodiments, it will be appreciated by those skilled in the art that various modifications may be made to the structures described above. For example, any other type of gravitational biasing of the centering bars 28, 30 could be employed. Other types of counter-balancing mechanisms could be used to offset or counter-balance the weight of floating heads 48, 50. Similarly, other types of mechanisms could be employed to allow these floating heads to float up and down. A mechanical linkage or cable arrangement could be used to operate pivoting arm assembly 58 rather than using an actuator 64. Finally, conveyor 18 could be eliminated or replaced by a portion of the existing packaging line 16, if suitable modifications are made to frame 12.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A box or carton sealer comprising:

a frame having a longitudinal axis and including a conveyor for moving boxes along said axis through the sealer;

a pair of longitudinal, laterally spaced-apart centering bars linked together to move inwardly and outwardly to match the width of a box passing therethrough, said bars including diverging entry portions forming a throat to center the box therebetween, and means for urging the bars inwardly into engagement with the box;

a first floating head spaced above the centering bars, said first head including an upwardly inclined entry ramp adapted to engage and fold inwardly a forward end flap on the box, said first head lifting upwardly by the box engaging said inclined entry ramp, said first head including a pivoting arm assembly pivotable downwardly after the box passes thereunder to fold inwardly a rearward end flap on the box, said first head further including diverging side bars for engaging and folding inwardly side flaps on the box after the rearward end flap has been folded inwardly; and a second floating head located downstream of the first floating head, the second floating head being adapted to mount a tape dispenser centrally thereon, the second floating head including means to hold the box side flaps down on top of the box end flaps, and an upwardly inclined entry ramp adapted to be engaged by the box on the conveyor to lift the second floating head to a predetermined desired height for engagement of the tape dispenser against the box flaps to tape the box shut.

2. A box sealer as claimed in claim 1 wherein the first and second floating heads include transverse members having distal ends, and wherein the frame includes upright towers including slides connected to said distal ends for up and down floating movement of the floating heads.

3. A box sealer as claimed in claim 2 wherein the towers further comprise counterweights connected to the slides to offset the weight of the floating heads.

4. A box sealer as claimed in claim 2 wherein the towers are inclined from the vertically in a direction away from the travel of the conveyor.

5. A box sealer as claimed in claim 4 wherein the towers are inclined at an angle of 15 degrees from the vertical.

6. A box sealer as claimed in claim 4 wherein the first floating head inclined entry ramp is inclined at an angle of about 35 degrees.

7. A box sealer as claimed in claim 4 wherein the second floating head inclined entry ramp is inclined at an angle of about 35 degrees.

8. A box sealer as claimed in claim 1 wherein said pivoting arm assembly includes a pivoting arm and an actuator operably coupled to said arm to pivot said arm into engagement with a rear flap of a box passing thereunder, and further comprising activating means connected to the actuator to operate said arm when the box rear flap passes thereunder.

9. A box sealer as claimed in claim 8 wherein said pivoting arm includes an offset distal end portion extending toward a box passing thereunder to engage the trailing side of said rear flap.

10. A box sealer as claimed in claim 1 wherein the first and second floating heads include upwardly inclined exit ramps adapted to engage a box passing thereunder to lower gently the floating heads as the box passes thereby.

11. A box sealer as claimed in claim 1 wherein the means for urging the bars inwardly includes transverse pivoting members attached thereto and pivotally mounted in the frame at points vertically spaced from the bars, said pivoting members including cantilevered weighted portions located to pivot said pivoting members and thus the bars by gravity into engagement with a box located between the bars.

12. A box sealer as claimed in claim 11 wherein the pivoting members are crescent shaped.

13. A box sealer as claimed in claim 12 wherein said pivoting members extend downwardly and inwardly under the bars.

14. A box sealer as claimed in claim 13 wherein said pivoting members include inner distal portions, said distal portions on laterally adjacent bars crossing, and further comprising a weight supported by said crossing distal portions.

15. A box sealer as claimed in claim 11 wherein said cantilevered weighted portions on each bar are weighted the same, so that each bar exerts the same lateral force on a box passing therethrough.

16. A box sealer as claimed in claim 11 and further comprising a linking mechanism coupling said transverse, pivoting members together to limit respective outward movement of the centering members until a box is centered therebetween.

17. A box sealer as claimed in claim 1 wherein said diverging entry portions of said bars are disposed at an angle from the longitudinal axis of between 25 and 40.

18. A box sealer as claimed in claim 17 wherein said entry portions are slightly upwardly inclined.

* * * * *